US005916182A

United States Patent [19]

Fengler

[11] Patent Number: 5,916,182

[45] Date of Patent: Jun. 29, 1999

[54] MASSAGING APPARATUS STORED UNDER A BED MOVABLE TO POSITION OVER THE BED

[76] Inventor: Wolfram F. O. Fengler, 12562 E. Putnam St., Whittier, Calif. 90606

[ * ] Notice: Under 35 U.S.C. 154(b), the term of this patent shall be extended for 83 days.

[21] Appl. No.: 08/506,423

[22] Filed: Jul. 24, 1995

[51] Int. Cl.[6] ..... A61H 15/00; A61H 23/02

[52] U.S. Cl. ..... 601/110; 601/111; 601/99; 601/117; 601/118; 601/128

[58] Field of Search ..... 601/97, 98, 84, 601/101, 103, 115–117, 110, 111, 99, 128, 118

[56] References Cited

U.S. PATENT DOCUMENTS

| | | | |
|---|---|---|---|
| 2,826,181 | 3/1958 | Holland | 601/108 |
| 3,078,843 | 2/1963 | Brisson | 601/108 X |
| 3,672,357 | 6/1972 | Ferguson | 601/95 |
| 3,799,155 | 3/1974 | Gerlich | 601/103 |
| 4,984,568 | 1/1991 | Persaud | 601/122 |
| 5,016,617 | 5/1991 | Tarlow et al. | 601/117 |
| 5,022,386 | 6/1991 | Kuniskis | 601/117 |
| 5,078,125 | 1/1992 | Schumacher | 601/101 |

FOREIGN PATENT DOCUMENTS

| | | | |
|---|---|---|---|
| 406098914 | 4/1994 | Japan | 601/97 |
| 2166351 | 5/1986 | United Kingdom | 601/117 |

*Primary Examiner*—Danton D. DeMille
*Attorney, Agent, or Firm*—Jack C. Munro

[57] ABSTRACT

A massaging apparatus (28) which is designed to be located within the space (26) under a bed (20). The massaging apparatus (28) includes a mounting arm (108) which can be moved from the space (26) under the bed (20) and pivoted to an upright position. When in the upright position an elongated arm (32) is connected to the mounting arm (108) and pivotable in a direction toward and away from the bed (20). The elongated arm (32) includes a massaging device (50) mounted on its outer end thereof. The massaging device (50) is to be capable of being separately driven in a reciprocating manner. The elongated arm (32) is to be appropriately counterbalanced (198) so that the massaging device (50) will apply a slight downward pressure onto the human (22) who is being massaged. The mounting arm (108) is to be moved over a preprogrammed path (48) which will also move the massaging device (50) in the same path on the body of the human (22).

7 Claims, 4 Drawing Sheets

MASSAGING APPARATUS STORED UNDER A BED MOVABLE TO POSITION OVER THE BED

BACKGROUND OF THE INVENTION

1) Field of the Invention

The field of this invention relates to massaging apparatuses and more particularly to a massaging apparatus for a human.

2) Description of the Prior Art

In the past there have been several different types of massaging devices for the human body. There have also been several attempts at designing a massaging device to be utilized in conjunction with a bed. All known,massaging devices in conjunction with a bed are incorporated within the mattress itself. This means that the massaging of the human occurs on the portion of the body that is in contact with the mattress.

If a human decides to partake of the service of a masseuse, the masseuse locates the human in a prone position on an elongated table and proceeds to massage the upper area of the body of the human. Over the years this has been developed to be the best technique for getting a massage. Even though it is acknowledged that massaging the human body from the top, as opposed to the undersurface of the human body, is most effective, prior to the present invention, all known prior art massaging apparatuses, when constructed in conjunction with a table or bed, applied the massage from the surface of the table or bed.

SUMMARY OF THE INVENTION

The primary objective of the present invention is to construct a massaging apparatus which applies the massage from above the body of the human when the human is located in a prone position.

Another objective of the present invention is to construct a massaging apparatus which is capable of being stored in the space provided under a conventional bed with this space being provided between the floor and the underside portion of the bed with the apparatus to be completely hidden from view.

Another objective of the present invention is that when the apparatus is in the storage position that it is quickly and easily movable to its operating position with the major portion of the apparatus still remaining in the storage position.

Another objective of the present invention is to construct a massaging apparatus which is most effective at providing a comfortable and enjoyable massage to the human user.

The massaging apparatus of the present invention comprises a rigid base on which is mounted appropriate electronics and a cross slide mechanism. Mounted on the cross slide mechanism is the inner end of an L-shaped mounting arm. This L-shaped mounting arm is to be movable from a storage position, where the arm is in juxtaposition with the base, to an extended position with the arm assuming a substantially upright position relative to the base. When in this upright position, the outer end of the mounting arm is to be connectable with an elongated arm. This elongated arm is mounted in a "teeter-totter" fashion on the mounting arm with the outer end of the elongated arm having mounted thereon a massaging device. The elongated arm includes a movable counterweight which is to be adjusted so that the massaging device will have a tendency to press lightly onto the skin of the human user. The mounting arm, the elongated arm and the massaging device are to be moved over a preprogrammed path as the mounting arm is moved on the cross slide mechanism. The massaging device is also separately driven by an electrical motor with the massaging being rapidly moved in a reciprocating manner.

DETAILED DESCRIPTION OF THE PREFERRED EMBODIMENT

Figures 1, 2, 3, 4, 5, 6:
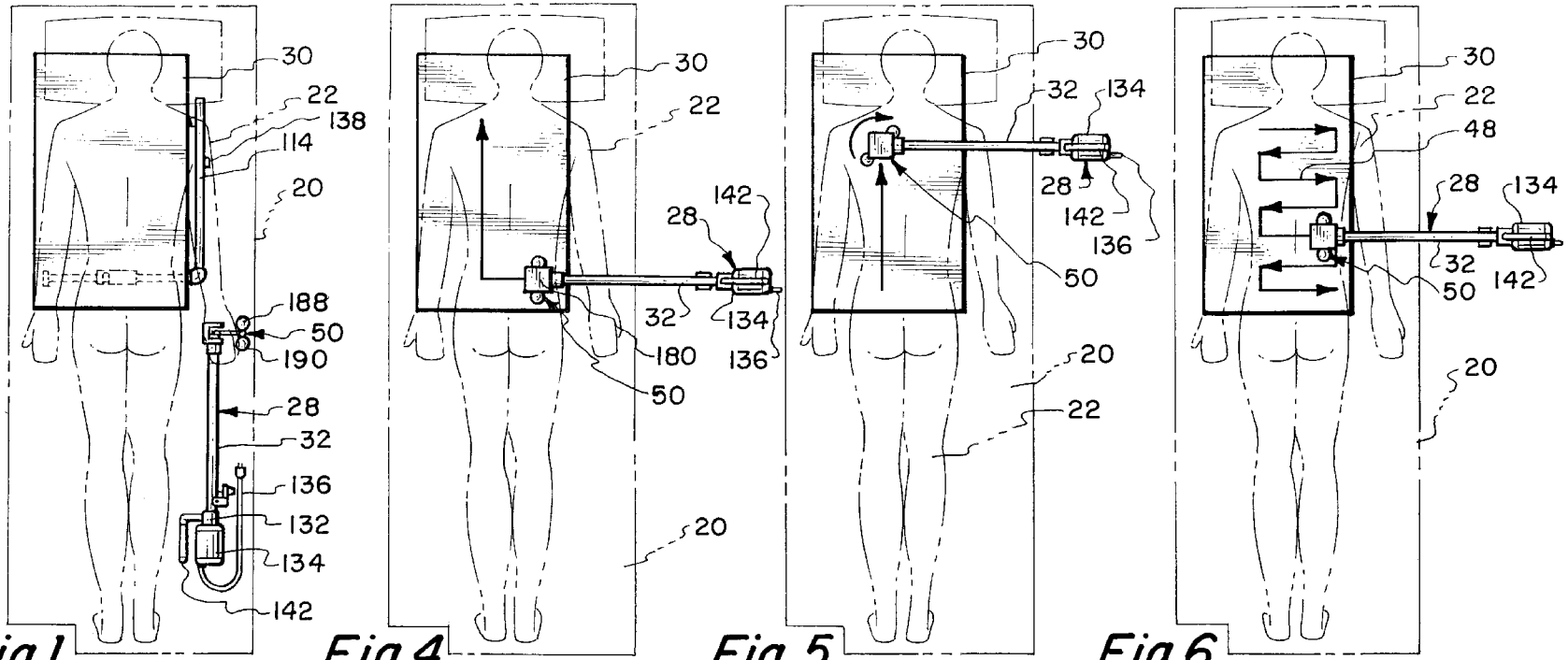
FIG. 1 is a top plan view depicting a human located in a prone position on a bed with both the human and the bed being shown in phantom lines with the massaging apparatus of the present invention being locate the storage position underneath the bed.
FIG. 2 is an end view taken at the foot of the bed showing the massaging apparatus of the present invention being moved to the operating position with the elongated arm of the massaging apparatus not yet installed in conjunction with the mounting arm.
FIG. 3 is a view similar to FIG. 2 but showing the elongated arm installed in conjunction with the mounting arm.
FIG. 4 is a view similar to FIG. 1 but showing the massaging apparatus in the initial operating position of its preprogrammed path.
FIG. 5 is a similar to FIG. 4 but showing the elongated arm in a further position along its preprogrammed path of movement.
FIG. 6 is a similar to FIG. 5 depicting the entire preprogrammed path of movement of the massaging apparatus.
Figure 7:
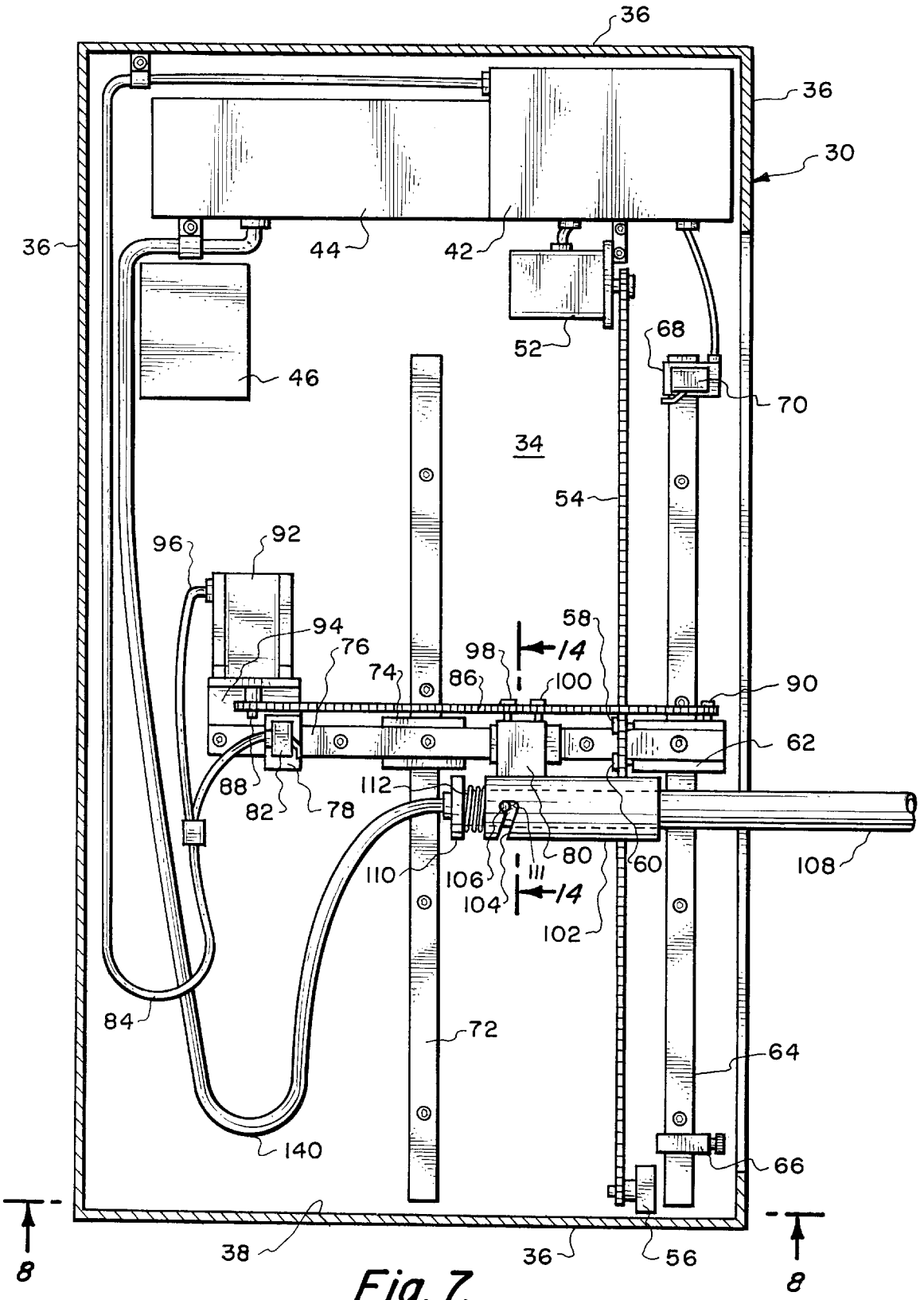
FIG. 7 is a top plan view of the base portion of the massaging apparatus taken along line 7—7 of FIG. 3.
Figures 8, 9:
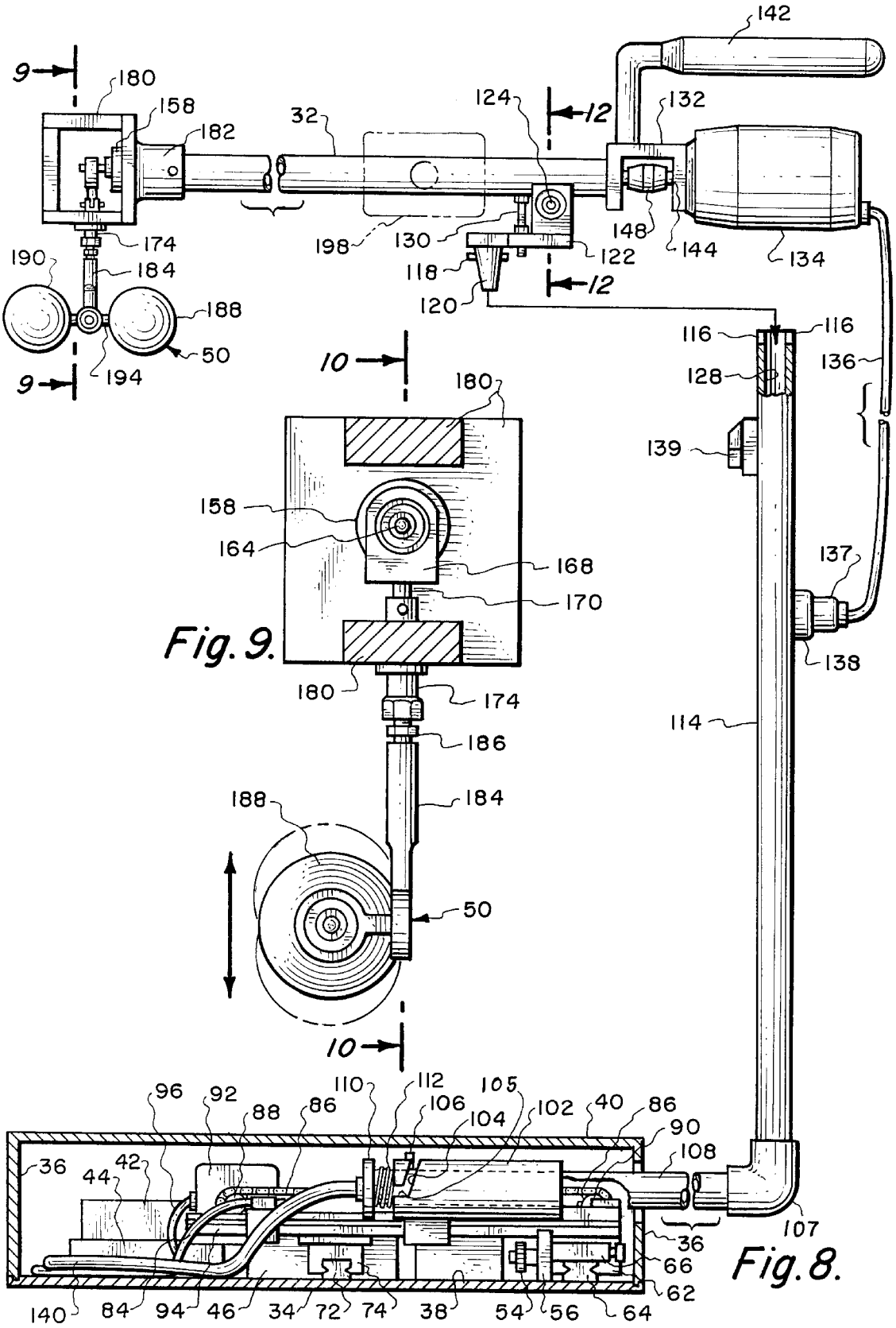
FIG. 8 is an end view, partly in cross section, of the massaging apparatus of the present invention taken along line 8—8 of FIG. 7 showing the elongated arm of the massaging apparatus disconnected from the mounting arm.
FIG. 9 is a cross-sectional view through the outer end of the elongated arm upon which is mounted the massaging device incorporated within the massaging apparatus of the present invention.
Figure 10:
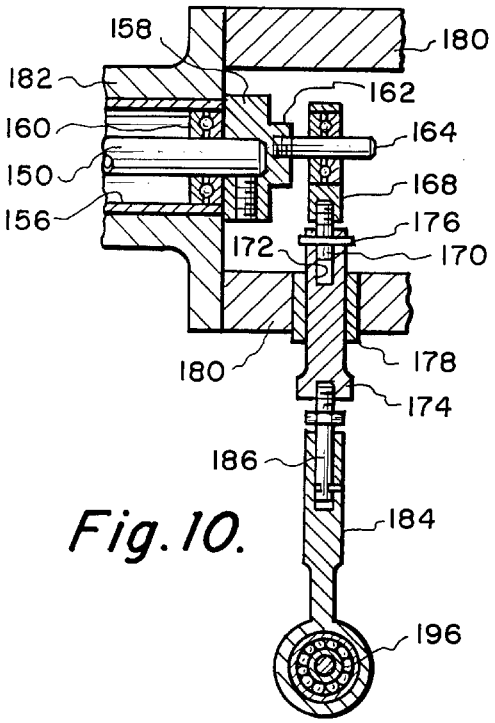
FIG. 10 is a cross-sectional view taken along line 10—10 of FIG. 9 showing the massaging device located at its uppermost limit of its reciprocating movement.
Figure 11:
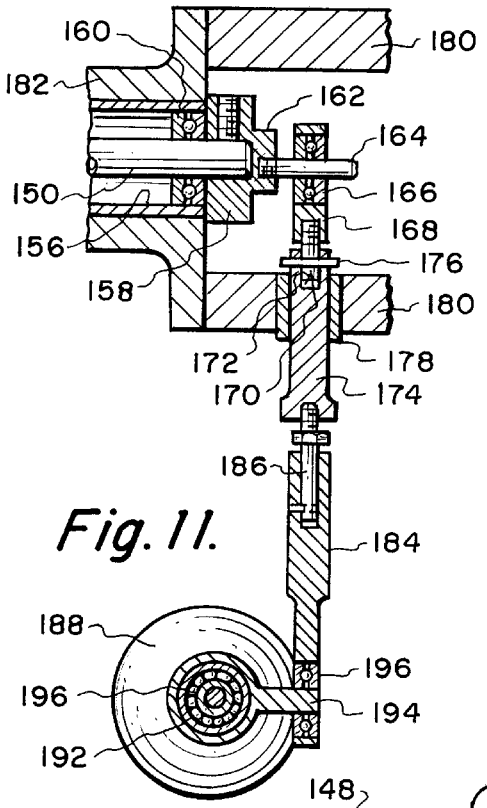
FIG. 11 is a view similar to FIG. 10 but showing the massaging device in its lowermost position of its reciprocating movement.
Figure 12:
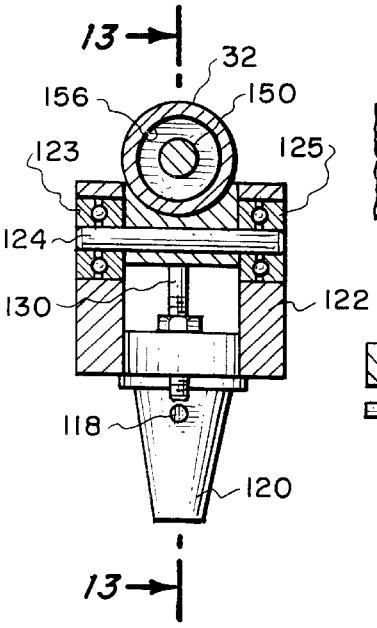
FIG. 12 is a cross-sectional view through a portion of the structure that is utilized to mount the elongated arm onto the mounting arm taken along line 12—12 of FIG. 8.
Figure 13:
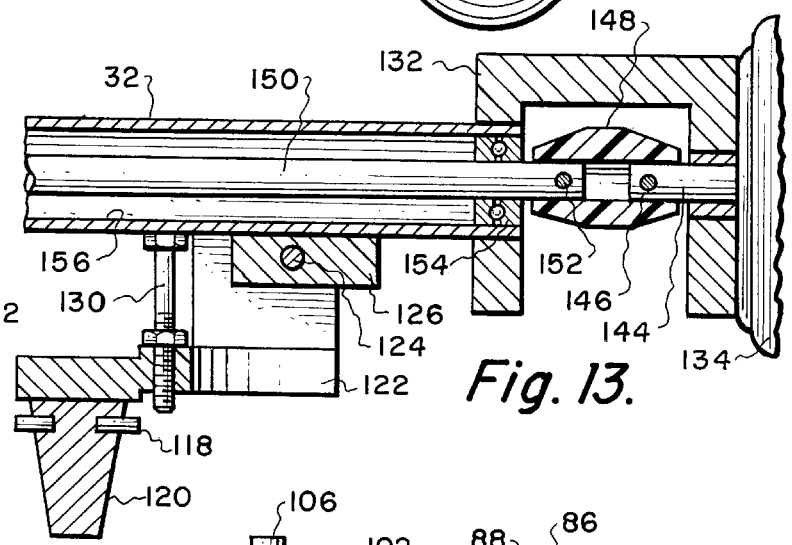
FIG. 13 is an enlarged cross-sectional view taken along line 13—13 of FIG. 12 showing in more detail the constructional arrangement of the elongated arm and the motor driving arrangement for the massaging device mounted at the outer end of the elongated arm.
Figure 14:
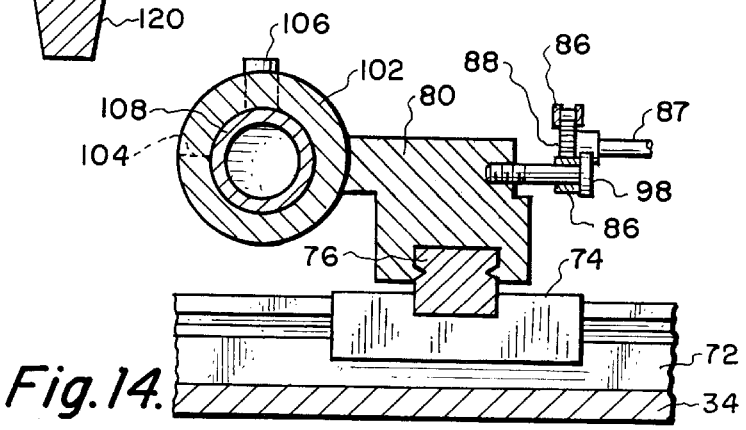
FIG. 14 is a cross-sectional view of the structure utilized to the mounting arm on the cross slide mechanism taken along line 14—14 of FIG. 7.

Referring particularly to the drawings, there is shown in FIGS. 1 to 6 a bed 20 upon which a human 22 is located in a prone position. The bed 20 is located on a floor 24. Between the floor 24 and the bed 20 is located a space 26. Within the space 26 there may be totally confined the massaging apparatus 28 of the present invention.

The massaging apparatus 28 is basically composed of a base 30 and an elongated arm 32. The base 30 will generally be in the form a rigid box having a planer bottom 34 and planer sidewalls 36. There will also be a planer top 40 that is connected across the top edge of the sidewalls 36 which encloses an interior chamber 38. The bottom 34 defines a base plane.

Mounted on the bottom 34 within the interior chamber 38 are boxes 42, 44 and 46. These boxes 42, 44 and 46 are to include appropriate electronics (not shown) which when connected to an appropriate power source (not shown) will cause elongated arm 32 to move across the body of the human 22 along a preprogrammed path 48. It is to be understood that the electronics can be modified to have the elongated arm 32 to move along any desired preprogrammed path 48. It is also considered to be within the scope of this invention that the human 22 can select any one of several different preprogrammed paths 48. Generally the preprogrammed path 48 will result in movement completely across an area of the body of the human 22 such as is shown the back area of the human 22.

Electrically connected to the electronics within box 42 is a stepping motor 52. Stepping motor 52 is mounted on the bottom 34. Stepping motors work well with electronics in establishing and continual repeating of the preprogrammed path of movement. The stepping motor 52 is connected to a chain drive 54. The chain drive 54 is mounted about an idler pulley 56 which is fixedly mounted on the bottom 34. One end of the chain drive 54 is pivotally secured to a pin 58 with the opposite end of the chain drive 54 being pivotally secured to a pin 60. Pins 58 and 60 are fixedly mounted to a block 62. The block 62 is slidingly mounted on a guide rail 64. The guide rail 64 is fixedly mounted on the bottom 34. It is to be noted that the block 62 is permitted to move only longitudinally on the guide rail 64. The block 62 will come into contact with a stop block 66 which is fixedly secured adjacent one end of the guide rail 64. The opposite end of the block 62 is capable of coming into contact with a stop block 68. This defines the limits of movement of block 62 with the block 62 not being able to be disengaged from the guide rail 64. Mounted on the stop block 68 is an electrical switch 70. The electrical switch 70, when contacted by the stop block 62, establishing the y-axis of the home position.

Mounted on the bottom 34 and located in a spaced but parallel relationship to the guide rail 64 is a second guide rail 72. Mounted in engagement with the second guide rail 72 is a block 74 with the block 74 being longitudinally movable on the second guide rail 72. Mounted on top of the blocks 62 and 74 is a guide rail 76. Movably engaged with the guide rail 76 is a block 80. The block 80 is capable of moving transversely between block 62 and block 78 which is mounted on the guide rail 76. The block 78 is mounted on a portion of the guide rail 76 that extends some distance from the second guide rail 72. An electrical switch 82 is mounted on the block 78. This electrical switch 82 is electrically connected by wire 84 to the electronics and upon block 80 coming into contact with the switch 82 will, by closing of the switch 82, establishing the x-axis of the home position. The chain drive 86 is connected between drive pulley 88 and idler pulley 90. Idler pulley 90 is mounted on the block 62. The drive pulley 88 is fixedly mounted on the drive shaft 87 of a stepping motor 92. The stepping motor 92 is mounted by bracket 94 onto the rail 76. The stepping motor 92 is electrically driven by the electronics through wire 96. One end of the chain drive 86 is pivotally connected to a pin 98 with the opposite end of the chain drive 86 being pivotally mounted on a pin 100. The pins 98 and 100 are fixedly mounted on the block 80.

What has previously been described in relation to the guide rails 64, 72 and 76 is what is deemed to be a cross slide mechanism. This mechanism will permit movement of the block 80 within a single plane in essence along an X and a Y axis which is parallel to the base plane of the bottom 34. The movement of the block 80 is limited in the transverse direction by the spacing between blocks 62 and 78 and in the longitudinal direction by the spacing between blocks 66 and 70. Fixedly secured to the block 80 is a sleeve 102. The sleeve 102 has formed therein a bayonet slot 104. Engaging with the bayonet slot 104 is a pin 106. The pin 106 is mounted on the inner end of a mounting arm 108 which is basically L-shaped in configuration. The inner end of the mounting arm 108 is fixedly mounted on a disc 110. In between the disc 110 and the sleeve 102 is a coil spring 112. The mounting arm 108 has a vertical section 114. The vertical section 114 is to be movable from a stowage position, which is located parallel to and in juxtaposition to bottom surface 34 as is shown in FIG. 1 of the drawings, to an extended position which locates the vertical section 114 substantially perpendicular to the bottom surface 34. In achieving this movement, arm 108 must be physically moved in an lineal outward direction relative to the sleeve 102 which results in the compressing of the spring 112. This will permit the pin 106 to move into slot 105 formed within an end of the bayonet slot 104. There is a notch 111 formed in the opposite end of the bayonet slot 104. This will then permit the pivoting action of the arm 108 between the retracted position and the extended position. Each time the arm 108 is moved, it is to be understood that the arm 108 must be moved outwardly in order to compress the spring 112 in order to achieve this pivoting movement. When the arm 108 is in the stowage position shown in FIG. 1, the pin 106 is displaced from the slot 105 and spaced from sleeve 102 located elbow 107 directly adjacent a sidewall 36. Initial movement of the vertical section requires that pin 106 reenter slot 105 to engage with bayonet slot 104.

The outer free end of the vertical section 114 includes a notch 116. The notch 116 is to be engaged with a pin 118. The pin 118 is mounted within tapered plug 120. Tapered plug 120 is fixedly mounted on a bracket 122. The bracket 122 is pivotally mounted by pivot pin 124 to a block 126. The pivot pin 124 is pivotally mounted by bearing assemblies 123 and 125 located within the bracket 122. Block 126 is fixedly mounted onto the elongated arm 32. Elongated arm 32 is capable of being pivoted about ninety degrees relative to the bracket 122. When the elongated arm 32 is in an essentially horizontal position with the tapered plug 120 being located within center through opening 128 of vertical section 114, the arm 32 will abut against threaded fastener 130. This defines the horizontal position of the elongated arm 32. The threaded fastener 130 is threadably secured within the bracket 122. Fixedly mounted on the aft end of the elongated arm 32 is a U-shaped bracket 132. Also mounted on the bracket 132 is a motor 134. The motor 134 is to be electrically driven by wire 136 which connects to male plug 137 which is to be mounted within female plug 138 which is mounted on the vertical section 114. The female plug 138 is electrically connected by wire 140 to the electronics. The switch 139 mounted on vertical section 114 is to vary the speed of motor 134. Switch 139 is also used to activate the electronics. Also mounted on the U-shaped bracket 132 is a handle 142. The handle 142 is for the purpose of physically carrying and mounting of the elongated arm 32 in its appropriate position. However, plug 120 could be fixed to vertical section 114. In such a case, handle 142, male plug 137 and female plug 138 would be eliminated.

The output shaft 144 of the motor 134 is fixedly mounted by a set screw 146 to a connector 148. The connector 148 is formed of a resilient material such as a rubber or plastic material. It is the function of the connector 148 dampen vibration in the transmission of power between shafts 144 and 150. Also connected to the connector 148 is one end of a shaft 150 with this connection being established by means of a set screw 152. The shaft 150 is mounted by a bearing assembly 154 within the center through channel 156 of the elongated arm 32. The outer end of the shaft 150 is fixedly mounted to a wheel 158. Shaft 150 is supported by bearing assembly 160 within the channel 156 that is located directly adjacent the wheel 158.

The wheel 158 includes an off center section 162. A pin 164 is fixedly mounted within the off center section 162 with the longitudinal center axis of the pin 164 always being located parallel to the longitudinal center axis of the shaft 150. The pin 164 is mounted by bearing assembly 166 within a plate 168. The plate 168 is fixedly connected to a pin 170. Pin 170 is located within a slot 172 formed with one end of a rod 174. The connection between the pin 170 and the rod 174 is established by means of a pin 176. When shaft 150 is rotated, the off center section 162 is driven eccentrically relative to the axis of rotation of the shaft 150. This eccentric rotation translates into a wobbling motion for the plate 168 which is driven from the off center section 162 by means of the pin 164. This wobbling motion produces the reciprocating motion of the rod 174 that is lineal because plate 168 is capable of pivoting slightly relative to rod 174 by means of the pivot pin 176.

The rod 174 is mounted permitting only lineal movement within a sleeve 178 which is mounted within a housing 180. The housing 180 is fixed onto a sleeve 182 which is fixedly mounted on the exterior surface of the elongated arm 32. A massager mounting rod 184 is fixedly secured to the outer end of the rod 174 with its securement being by means of threaded fastener 186. The mounting rod 184 can be interchanged with other mounting rods for different types of massaging devices. The massaging device 50 shown is composed of a pair of balls 188 and 190. These balls 188 and 190 are mounted by bearing assemblies 192 onto a mounting rod 194. The mounting rod 194 is low frictionally mounted by means of a bearing assembly 196 onto the mounting rod 184. The balls are free to pivot about seventy-five degrees. The balls 188 and 190 actually contact the mounting rod 184 at the limits of their pivotable movement.

The operation of the massaging apparatus 28 of this invention is as follows: As previously mentioned, the user is to remove the elongated arm 32 and its associated structure from the space 26 underneath the bed 20. The user then manually grabs the vertical section 114 by pulling outwardly which will then permit the vertical section to be pivoted to an upright position as is clearly shown in FIG. 2. The vertical section 114 will be locked in this position upon such being released with the pin 106 coming into contact with an appropriate notch formed within the bayonet slot 104. If the elongated arm 32 is separate, it then connected to the outer free end of the vertical section 114 by pin 118 coming into contact with notch 116 and tapered plug 120 pressing within center opening 128. If the arm 32 is fixed to vertical section 114, the arm 32 is just pivoted into a horizontal position. It can thus be seen that the elongated arm 32 assumes a "teeter-totter" type action and is capable of freely pivoting on the center section 114.

Normally the weight of the motor 134 will almost counterbalance the weight of the massaging device 50 so that there will be a slight downward pressure of the massaging device 50 onto the human 22. However, if this is not the case, a counterweight 198 is to be manually adjusted by being moved along the elongated arm 32 and then set in position in order to achieve this particular slight downwardly directed force. The user then connects the male plug 137 to the female plug 138 connecting the motor 134 to the electronics contained within the base 30. Turning on switch 139 will cause the massaging device 50 to be moved to a home position which would be with the block 80 in contact with switch 82 and block 62 in contact with switch 70. At that particular time, the massaging device 50 will then move through its preprogrammed path 48. While the massaging device 50 is moving along its preprogrammed path 48 which it will do repeatedly as long as the apparatus is activated, the motor 134 is causing the massaging device 50 to reciprocate a slight limited distance. This reciprocation produces a massaging action on the body of the human 22.

What is claimed is:

1. In combination with a bed that is located on a floor, a space located between said bed and said floor, a massaging apparatus totally confined within said space, the improvement comprising:

a portion of said massaging apparatus to be movable from said space and located in a suspended position above said bed, upon operation of said massaging apparatus said portion to apply massaging therapy to a human located on said bed from above said bed and upon termination of the operation said portion to be moved and relocated within said space.

2. The combination as defined in claim 1 wherein:

said portion includes a pivotally mounted arm which has a massaging device mounted thereon which is to directly produce said massaging therapy.

3. The combination as defined in claim 1 wherein:

said portion being electrically driven to apply said massaging therapy.

4. The combination as defined in claim 1 wherein:

said portion being adjustable in distance from said bed.

5. The combination as defined in claim 1 wherein:

said portion to be moved in a reciprocating manner in order to apply said massaging therapy.

6. A massaging apparatus comprising:

a base, said base having a bottom, said bottom being planer defining a base plane:

a mounting arm pivotally mounted on said base, said mounting arm being movable relative to said base between an extended position and a stowage position, said stowage position locating said mounting arm in Juxtaposition with said base, said extending position locating said mounting arm in an outwardly extending position from said base;

a cross slide mechanism mounted on said base, said mounting arm being mounted on said cross slide mechanism, said mounting arm being lineally movable within a single plane parallel to said base plane, movement of said mounting arm within said single plane being permitted by said cross slide mechanism, said mounting arm being pivotally movable relative to said single plane causing said mounting arm to assume an outwardly extending position relative to said single plane, said mounting arm being fixable in said outwardly extending position;

said mounting arm having a free outer end, an elongated arm being mounted on said free outer end, said elongated arm having a massaging device, said elongated arm and said massaging device being movable toward and away from said base, said massaging device being separately movable a limited distance toward and away from said base;

said elongated arm being removably mounted on said mounting arm; and said elongated arm including a counterweight, said counterweight being movable on said elongated arm.

7. The massaging apparatus as defined in claim 6 wherein:

said elongated arm being pivotally mounted on said mounting arm permitting said movement of said elongated arm and massaging device toward and away from said base.

* * * * *